US010163613B2

(12) United States Patent
Cox et al.

(10) Patent No.: US 10,163,613 B2
(45) Date of Patent: Dec. 25, 2018

(54) DECONVOLUTION OF MIXED SPECTRA

(71) Applicant: DH Technologies Development Pte. Ltd., Singapore (SG)

(72) Inventors: David Michael Cox, Toronto (CA); Gordana Ivosev, Etobicoke (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 15/750,550

(22) PCT Filed: Aug. 9, 2016

(86) PCT No.: PCT/IB2016/054776
§ 371 (c)(1),
(2) Date: Feb. 6, 2018

(87) PCT Pub. No.: WO2017/025892
PCT Pub. Date: Feb. 16, 2017

(65) Prior Publication Data

US 2018/0240658 A1 Aug. 23, 2018

Related U.S. Application Data

(60) Provisional application No. 62/204,510, filed on Aug. 13, 2015.

(51) Int. Cl.
*H01J 49/00* (2006.01)
*H01J 49/26* (2006.01)
*H01J 49/04* (2006.01)

(52) U.S. Cl.
CPC ..... *H01J 49/0031* (2013.01); *H01J 49/0045* (2013.01); *H01J 49/04* (2013.01); *H01J 49/26* (2013.01)

(58) Field of Classification Search
CPC ..... H01J 49/0027; H01J 49/0031; H01J 49/0036; H01J 49/0045; H01J 49/004; H01J 49/26; G01N 33/6848
See application file for complete search history.

(56) References Cited

U.S. PATENT DOCUMENTS 9,269,555 B2 * 2/2016 Tate ..... H01J 49/0031
9,583,323 B2 * 2/2017 Tate ..... H01J 49/0031
(Continued)

FOREIGN PATENT DOCUMENTS

WO 2014076529 A1 5/2014

OTHER PUBLICATIONS

International Search Report and Written Opinion for PCT/IB2016/054776 dated Dec. 1, 2016.

*Primary Examiner* — David E Smith
(74) *Attorney, Agent, or Firm* — John R. Kasha; Kelly L. Kasha; Kasha Law LLC

(57) ABSTRACT

An m/z range of an ion beam is divided into two or more precursor ion mass selection windows. A pattern of two or more different window m/z ranges to be used during two or more successive cycles for at least one precursor ion mass selection window is determined. The pattern includes an initial window m/z range and one or more successively different window m/z ranges. Each of the one or more successively different window m/z ranges includes at least a portion of the initial window m/z range. A tandem mass spectrometer is instructed to select and fragment the two or more precursor ion mass selection windows during each cycle of a plurality of cycles and to repeatedly use the pattern for each group of two or more successive cycles of the plurality of cycles for the selection and fragmentation of the at least one precursor ion mass selection window.

15 Claims, 10 Drawing Sheets

(56) References Cited

U.S. PATENT DOCUMENTS

| | | | | |
|---|---|---|---|---|
| 2013/0153761 | A1* | 6/2013 | Bonner | H01J 49/0031 250/282 |
| 2013/0240723 | A1* | 9/2013 | Bonner | H01J 49/0045 250/282 |
| 2014/0239170 | A1 | 8/2014 | Okumura | |
| 2015/0102219 | A1 | 4/2015 | Yamamoto | |
| 2015/0144778 | A1 | 5/2015 | Bonner et al. | |

* cited by examiner

100

DECONVOLUTION OF MIXED SPECTRA

CROSS REFERENCE TO RELATED APPLICATION

This application claims the benefit of U.S. Provisional Patent Application Ser. No. 62/204,510, filed Aug. 13, 2015, the content of which is incorporated by reference herein in its entirety.

INTRODUCTION

Various embodiments relate generally to mass spectrometry. More particularly various embodiments relate to systems and methods for obtaining a pure product ion or mass spectrometry/mass spectrometry (MS/MS) spectrum for a compound of interest. Such a pure product ion spectrum is used, for example, to identify or quantitate a compound of interest in a complex mixture.

Tandem mass spectrometry, or MS/MS, is a well-known technique for analyzing compounds. Originally a tandem mass spectrometer was thought of as two mass spectrometers arranged in tandem. However, modern tandem mass spectrometers are much more complex instruments and may have many different configurations. Generally, however, tandem mass spectrometry involves ionization of one or more compounds from a sample, selection of one or more precursor ions of the one or more compounds, fragmentation of the one or more precursor ions into product ions, and mass analysis of the product ions.

Tandem mass spectrometry can provide both qualitative and quantitative information. The product ion spectrum can be used to identify a molecule of interest. The intensity of one or more product ions can be used to quantitate the amount of the compound present in a sample.

A large number of different types of experimental methods or workflows can be performed using a tandem mass spectrometer. Two broad categories of these workflows are information dependent acquisition (IDA) and data independent acquisition (DIA).

IDA is a flexible tandem mass spectrometry method in which a user can specify criteria for performing MS/MS while a sample is being introduced into the tandem mass spectrometer. For example, in an IDA method a precursor ion or mass spectrometry (MS) survey scan is performed to generate a precursor ion peak list. The user can select criteria to filter the peak list for a subset of the precursor ions on the peak list. MS/MS is then performed on each precursor ion of the subset of precursor ions. A product ion spectrum is produced for each precursor. MS/MS is repeatedly performed on the precursor ions of the subset of precursor ions as the sample is being introduced into the tandem mass spectrometer. The sample is introduced through an injection or chromatographic run, for example.

In one type of IDA method, a single precursor ion is selected and fragmented, and an entire mass range of product ions is mass analyzed. This type of MS/MS scan is referred to as full scan MS/MS or a full product ion MS/MS scan. Full scan MS/MS is typically used for qualitative analysis. In other words, full scan MS/MS is typically used to identify a precursor ion from a pattern of product ions.

In a second type of IDA method, a single precursor ion is selected and fragmented, a single product ion is then selected from the resulting product ions, and only the selected product ion is mass analyzed. This type of MS/MS is referred to as multiple reaction monitoring (MRM) or selected reaction monitoring (SRM) or as an MRM or SRM scan or transition. MRM is typically used for quantitative analysis. In other words, MRM is typically used to quantify the amount of a precursor ion in a sample from the intensity of a single product ion.

Some tandem mass spectrometers, such as AB SCIEX's QTRAP®, allow IDA methods to perform MRM and full scan MS/MS in a single experiment. As a result, both quantitative and qualitative data can be acquired in a single experiment. This is very useful for multi-analyte screening methods, which include drug testing and pesticide screening methods, among others.

However, in proteomics, and many other sample types, the complexity and dynamic range of compounds is very large. This poses challenges for traditional IDA methods, requiring very high speed MS/MS acquisition to deeply interrogate the sample in order to both identify and quantify a broad range of analytes.

As a result, DIA methods have been used to increase the reproducibility and comprehensiveness of data collection. DIA methods can also be called non-specific fragmentation methods. In a traditional DIA method, the actions of the tandem mass spectrometer are not varied among MS/MS scans based on data acquired in a previous precursor or product ion scan. Instead a precursor ion mass range is selected. A precursor ion mass selection window is then stepped across the precursor ion mass range. All precursor ions in the precursor ion mass selection window are fragmented and all of the product ions of all of the precursor ions in the precursor ion mass selection window are mass analyzed.

The precursor ion mass selection window used to scan the mass range can be very narrow so that the likelihood of multiple precursors within the window is small. This type of DIA method is called, for example, $MS/MS^{ALL}$. In an $MS/MS^{ALL}$ method a precursor ion mass selection window of about 1 amu is scanned or stepped across an entire mass range. A product ion spectrum is produced for each 1 amu precursor mass window. A product ion spectrum for the entire precursor ion mass range is produced by combining the product ion spectra for each mass selection window. The time it takes to analyze or scan the entire mass range once is referred to as one scan cycle. Scanning a narrow precursor ion mass selection window across a wide precursor ion mass range during each cycle, however, is not practical for some instruments and experiments.

As a result, a larger precursor ion mass selection window, or selection window with a greater width, is stepped across the entire precursor mass range. This type of DIA method is called, for example, SWATH™ acquisition. In SWATH™ acquisition the precursor ion mass selection window stepped across the precursor mass range in each cycle may have a width of 5-25 amu, or even larger. Like the $MS/MS^{ALL}$ method, all the precursor ions in each precursor ion mass selection window are fragmented, and all of the product ions of all of the precursor ions in each mass isolation window are mass analyzed. However, because a wider precursor ion mass selection window is used, the cycle time can be significantly reduced in comparison to the cycle time of the $MS/MS^{ALL}$ method.

U.S. Pat. No. 8,809,770 describes how SWATH™ acquisition can be used to provide quantitative and qualitative information about the precursor ions of compounds of interest. In particular, the product ions found from fragmenting a precursor ion mass selection window are compared to a database of known product ions of compounds of interest. In addition, ion traces or extracted ion chromatograms (XICs) of the product ions found from fragmenting a precursor ion mass selection window are analyzed to provide quantitative and qualitative information.

SWATH™ acquisition, however, is not without limitations. For example, in conventional SWATH™ acquisition, it can be difficult to identify the precursor ions of products ions fragmented in the same precursor ion mass selection window, when the precursor ion mass selection window includes multiple precursor ions. In addition, it can be difficult to deconvolve product ions, when a number of precursor ions that share product ions of the same mass-to-charge ratio (m/z) are present in the same precursor ion mass selection window. The non-specific nature of SWATH™ acquisition typically does not provide enough precursor ion information to aid in the identification. In other words, it can be difficult to determine which product ions belong to which precursor ions using conventional SWATH™ acquisition.

SUMMARY

A system is disclosed for providing precursor ion information in a tandem mass spectrometry data independent acquisition (DIA) experiment by changing the mass-to charge ratio (m/z) range of precursor ion mass section windows among cycles. The system includes a sample introduction device, an ion source, a tandem mass spectrometer, and a processor.

The sample introduction device introduces one or more compounds of a sample over time. The ion source is configured to receive the one or more compounds from the sample introduction device and ionize the one or more compounds, producing an ion beam of precursor ions. The tandem mass spectrometer is configured to receive the ion beam of precursor ions and select and fragment an m/z range of the ion beam during each cycle of a plurality of cycles.

The processor divides the ion beam m/z range into two or more precursor ion mass selection windows. Each precursor ion mass selection window of the two or more precursor ion mass selection windows has an initial window m/z range corresponding to part of the ion beam m/z range.

For at least one precursor ion mass selection window of the two or more precursor ion mass selection windows, the processor instructs the tandem mass spectrometer to perform a precursor ion survey scan mass analysis of the least one precursor ion mass selection window. A precursor ion mass spectrum that determines m/z values of precursor ions in the at least one precursor ion mass selection window is produced. This precursor ion survey scan mass analysis is performed at run time for each experiment. The precursor ion survey scan allows a pattern of window m/z ranges for the at least one precursor ion mass selection window to be determined dynamically.

The processor further determines a pattern of two or more different window m/z ranges to be used during two or more successive cycles for at least one precursor ion mass selection window of the two or more precursor ion mass selection windows that includes the initial window m/z range and one or more successively different window m/z ranges. Each of the one or more successively different window m/z ranges are chosen so that at least one precursor ion found in the precursor ion mass spectrum of the at least one precursor ion mass selection window remains in the at least one precursor ion mass selection window for all the one or more successively different window m/z ranges and the other precursor ions found in the precursor ion spectrum of the at least one precursor ion mass selection window end up in at least one other precursor ion mass selection window for at least one of the one or more successively different window m/z ranges.

The processor further instructs the tandem mass spectrometer to select and fragment the two or more precursor ion mass selection windows during each cycle of the plurality of cycles and to repeatedly use the pattern of two or more different window m/z ranges for each group of two or more successive cycles of the plurality of cycles for the selection and fragmentation of the at least one precursor ion mass selection window. A product ion spectrum is produced for each precursor ion mass selection window of the two or more precursor ion mass selection windows for each cycle. Product ion spectra are produced for the at least one precursor ion mass selection window that include an effect of the repeated use of the pattern.

A method for providing precursor ion information in a tandem mass spectrometry DIA experiment by dynamically changing the m/z range of precursor ion mass section windows among cycles. One or more compounds of a sample over time are introduced using a sample introduction device. The one or more compounds are ionized using an ionization device, producing an ion beam of precursor ions. The ion beam is received using a tandem mass spectrometer configured to select and fragment an m/z range of the ion beam during each cycle of a plurality of cycles.

The ion beam m/z range is divided into two or more precursor ion mass selection windows using a processor. Each precursor ion mass selection window of the two or more precursor ion mass selection windows has an initial window m/z range corresponding to part of the ion beam m/z range.

For at least one precursor ion mass selection window of the two or more precursor ion mass selection windows, the tandem mass spectrometer is instructed to perform a precursor ion survey scan mass analysis of the least one precursor ion mass selection window. A precursor ion mass spectrum that determines m/z values of precursor ions in the at least one precursor ion mass selection window is produced. This precursor ion survey scan mass analysis is performed at run time for each experiment. The precursor ion survey scan allows a pattern of window m/z ranges for the at least one precursor ion mass selection window to be determined dynamically.

A pattern of two or more different window m/z ranges to be used during two or more successive cycles for at least one precursor ion mass selection window of the two or more precursor ion mass selection windows is determined using the processor. The pattern includes the initial window m/z range and one or more successively different window m/z ranges. Each of the one or more successively different window m/z ranges are chosen so that at least one precursor ion found in the precursor ion mass spectrum of the at least one precursor ion mass selection window remains in the at least one precursor ion mass selection window for all the one or more successively different window m/z ranges and the other precursor ions found in the precursor ion spectrum of the at least one precursor ion mass selection window end up in at least one other precursor ion mass selection window for at least one of the one or more successively different window m/z ranges.

The tandem mass spectrometer is instructed to select and fragment the two or more precursor ion mass selection windows during each cycle of the plurality of cycles using the processor. The tandem mass spectrometer is also instructed to repeatedly use the pattern of two or more different window m/z ranges for each group of two or more successive cycles of the plurality of cycles for the selection and fragmentation of the at least one precursor ion mass selection window using the processor. A product ion spectrum is produced for each precursor ion mass selection window of the two or more precursor ion mass selection windows for each cycle. Product ion spectra are produced for the at least one precursor ion mass selection window that include an effect of the repeated use of the pattern.

A computer program product is disclosed that includes a non-transitory and tangible computer-readable storage medium whose contents include a program with instructions being executed on a processor so as to perform a method for providing precursor ion information in a tandem mass spectrometry DIA experiment by dynamically changing the m/z range of precursor ion mass section windows among cycles. In various embodiments, the method includes providing a system, wherein the system comprises one or more distinct software modules, and wherein the distinct software modules comprise an analysis module and a control module.

The analysis module receives an m/z range of an ion beam of precursor ions. The ion beam is received by a tandem mass spectrometer configured to select and fragment the ion beam m/z range during each cycle of a plurality of cycles. The ion beam is produced by an ionization device that receives and ionizes one or more compounds of a sample. The one or more compounds are produced by a sample introduction device that introduces one or more compounds of a sample over time.

The analysis module divides the ion beam m/z range into two or more precursor ion mass selection windows. Each precursor ion mass selection window of the two or more precursor ion mass selection windows has an initial window m/z range corresponding to part of the ion beam m/z range.

For at least one precursor ion mass selection window of the two or more precursor ion mass selection windows, the control module instructs the tandem mass spectrometer to perform a precursor ion survey scan mass analysis of the least one precursor ion mass selection window. A precursor ion mass spectrum that determines m/z values of precursor ions in the at least one precursor ion mass selection window is produced. This precursor ion survey scan mass analysis is performed at run time for each experiment. The precursor ion survey scan allows a pattern of window m/z ranges for the at least one precursor ion mass selection window to be determined dynamically.

The analysis module determines a pattern of two or more different window m/z ranges to be used during two or more successive cycles for at least one precursor ion mass selection window of the two or more precursor ion mass selection windows. The pattern includes the initial window m/z range and one or more successively different window m/z ranges. Each of the one or more successively different window m/z ranges are chosen so that at least one precursor ion found in the precursor ion mass spectrum of the at least one precursor ion mass selection window remains in the at least one precursor ion mass selection window for all the one or more successively different window m/z ranges and the other precursor ions found in the precursor ion spectrum of the at least one precursor ion mass selection window end up in at least one other precursor ion mass selection window for at least one of the one or more successively different window m/z ranges.

The control module instructs the tandem mass spectrometer to select and fragment the two or more precursor ion mass selection windows during each cycle of the plurality of cycles. The control module also instructs the tandem mass spectrometer to repeatedly use the pattern of two or more different window m/z ranges for each group of two or more successive cycles of the plurality of cycles for the selection and fragmentation of the at least one precursor ion mass selection window. A product ion spectrum is produced for each precursor ion mass selection window of the two or more precursor ion mass selection windows for each cycle. Product ion spectra are produced for the at least one precursor ion mass selection window that include an effect of the repeated use of the pattern.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
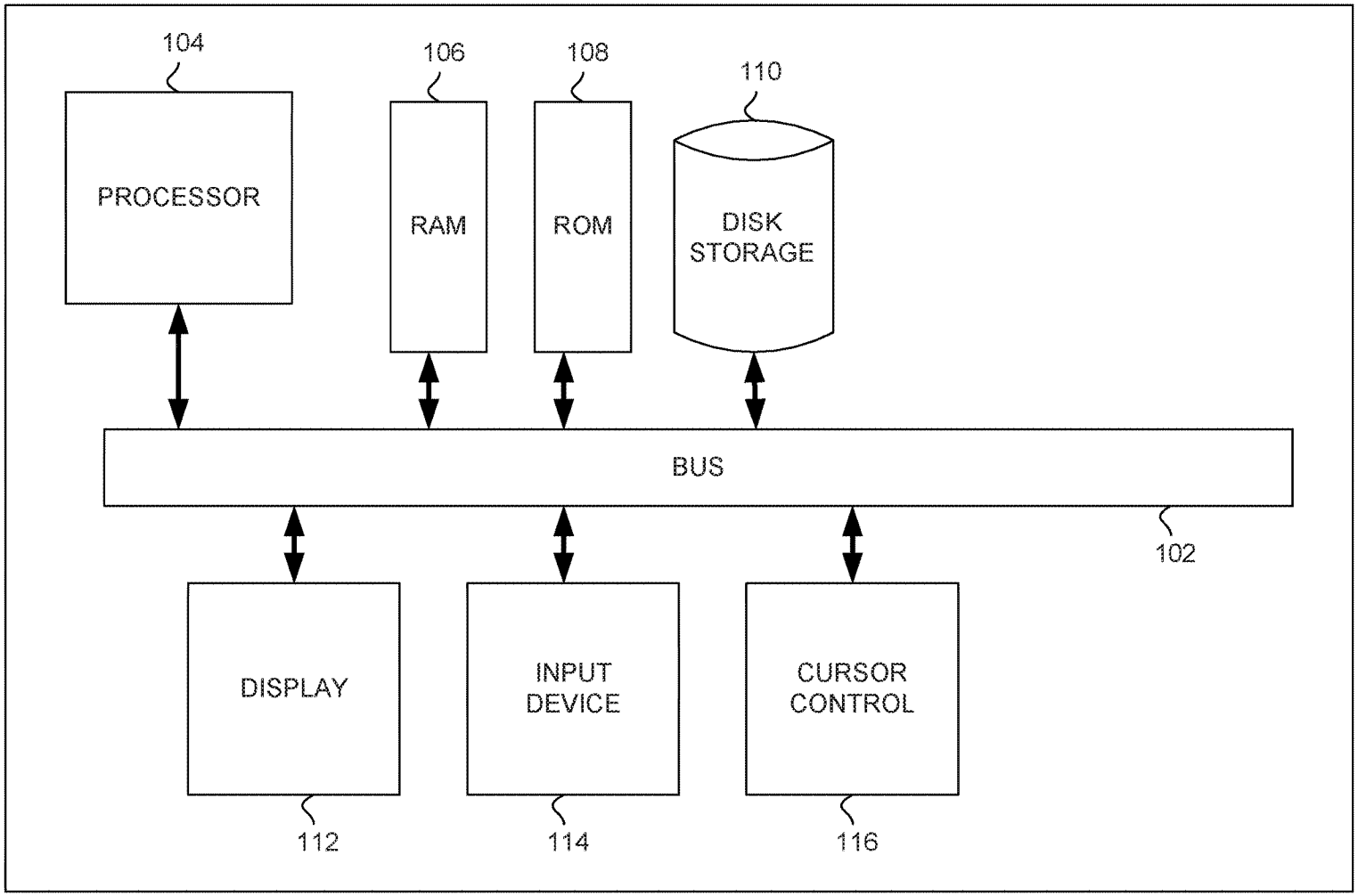
FIG. 1 is a block diagram that illustrates a computer system, upon which embodiments of the present teachings may be implemented.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

In various embodiments, computer system 100 can be connected to one or more other computer systems, like computer system 100, across a network to form a networked system. The network can include a private network or a public network such as the Internet. In the networked system, one or more computer systems can store and serve the data to other computer systems. The one or more computer systems that store and serve the data can be referred to as servers or the cloud, in a cloud computing scenario. The one or more computer systems can include one or more web servers, for example. The other computer systems that send and receive data to and from the servers or the cloud can be referred to as client or cloud devices, for example.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media or computer program products include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Changing Selection Windows Among Cycles

As described above, data independent acquisition (DIA) methods have been used to increase the reproducibility and comprehensiveness of data collection for complex samples. In particular, SWATH™ acquisition is a DIA method that increases the reproducibility and comprehensiveness of data collection without significantly impacting cycle time.

SWATH™ acquisition, however, is not without limitations. For example, in conventional SWATH™ acquisition, it can be difficult to identify the precursor ions of products ions fragmented in the same precursor ion mass selection window, when the precursor ion mass selection window includes multiple precursor ions. In addition, it can be difficult to deconvolve product ions, when a number of precursor ions that share product ions of the same mass-to-charge ratio (m/z) are present in the same precursor ion mass selection window. A measured product ion intensity is convolved, for example, when it consists of intensity contributions from product ions of two or more different precursor ions. Convolution therefore occurs when two or more precursor ions that have product ions of the same or similar m/z value are fragmented in the same precursor ion mass selection window at the same time.

Figure 2:
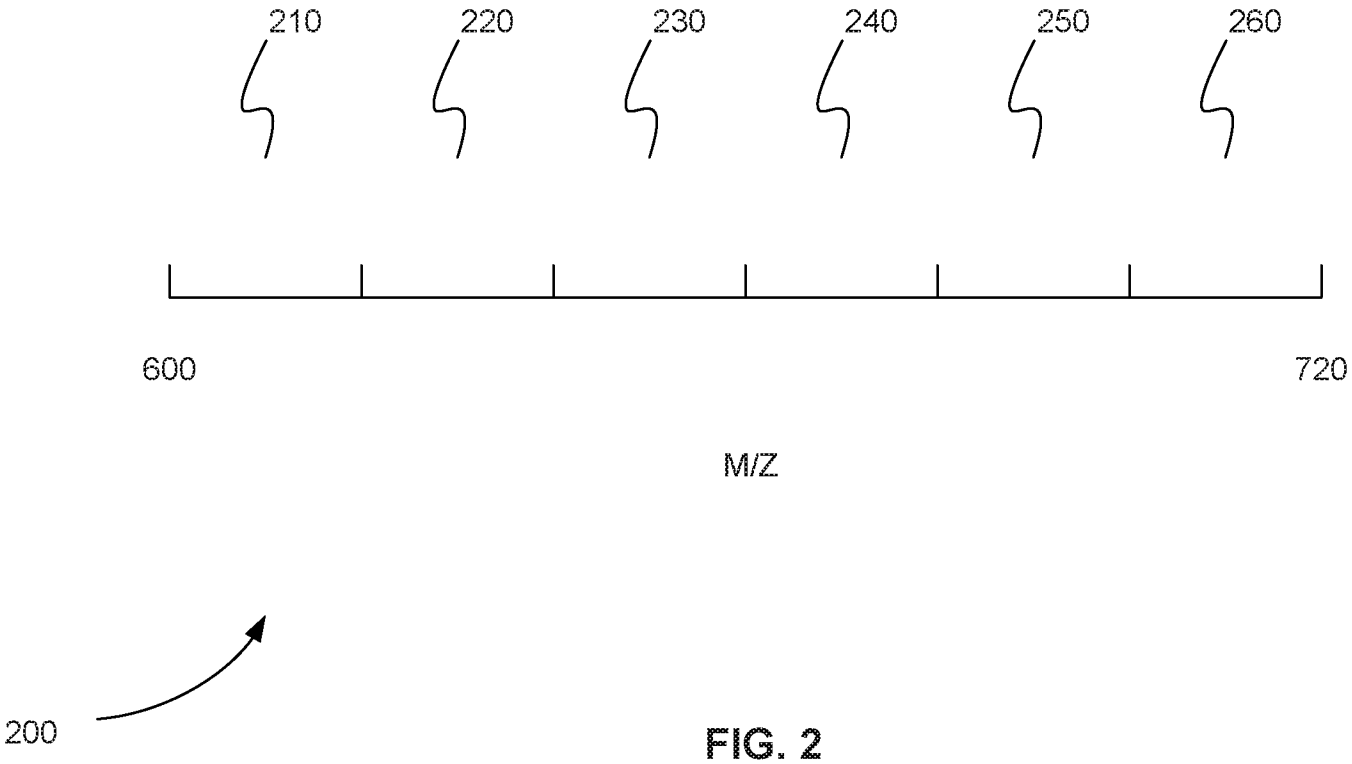
FIG. 2 is an exemplary diagram of a precursor ion mass-to-charge ratio (m/z) range that is divided into six precursor ion mass selection windows for a data independent acquisition (DIA) workflow, in accordance with various embodiments.

FIG. 2 is an exemplary diagram 200 of a precursor ion mass-to-charge ratio (m/z) range that is divided into six precursor ion mass selection windows for a data independent acquisition (DIA) workflow, in accordance with various embodiments. The m/z range shown in FIG. 2 is 120 m/z. Note that the terms "mass" and "m/z" are used interchangeably herein. Generally, mass spectrometry measurements are made in m/z and converted to mass by multiplying by charge.

Each of the six precursor ion mass selection or isolation windows 210-260 spans or has a width of 20 m/z. Precursor ion mass selection windows 210-260 are shown as non-overlapping windows with the same width. In various embodiments, precursor ion mass selection windows can overlap and/or can have variable widths. U.S. patent application Ser. No. 14/401,032 describes using overlapping precursor ion mass selection windows in a single cycle of SWATH™ acquisition, for example. U.S. Pat. No. 8,809,772 describes using precursor ion mass selection windows with variable widths in a single cycle of SWATH™ acquisition using variable precursor ion mass selection windows in SWATHTM acquisition, for example. In a conventional SWATH™ acquisition, each of precursor ion mass selection windows 210-260 is selected and then fragmented, producing six product ion spectra for the entire m/z range shown in FIG. 2.

FIG. 2 depicts non-variable and non-overlapping precursor ion mass selection windows 210-260 used in a single cycle of an exemplary SWATH™ acquisition. A tandem mass spectrometer that can perform a SWATH™ acquisition method can further be coupled with a sample introduction or separation device that provides the sample over time, for example. As a result, for each time step, each of precursor ion mass selection windows 210-260 is selected and then fragmented, producing six product ion spectra for the entire m/z range. In other words, each of precursor ion mass selection windows 210-260 is selected and then fragmented during each cycle of a plurality of cycles. A sample introduction device can introduce a sample to the tandem mass spectrometer using a technique that includes, but is not limited to, injection, liquid chromatography, gas chromatography, capillary electrophoresis, or ion mobility.

Figure 3:
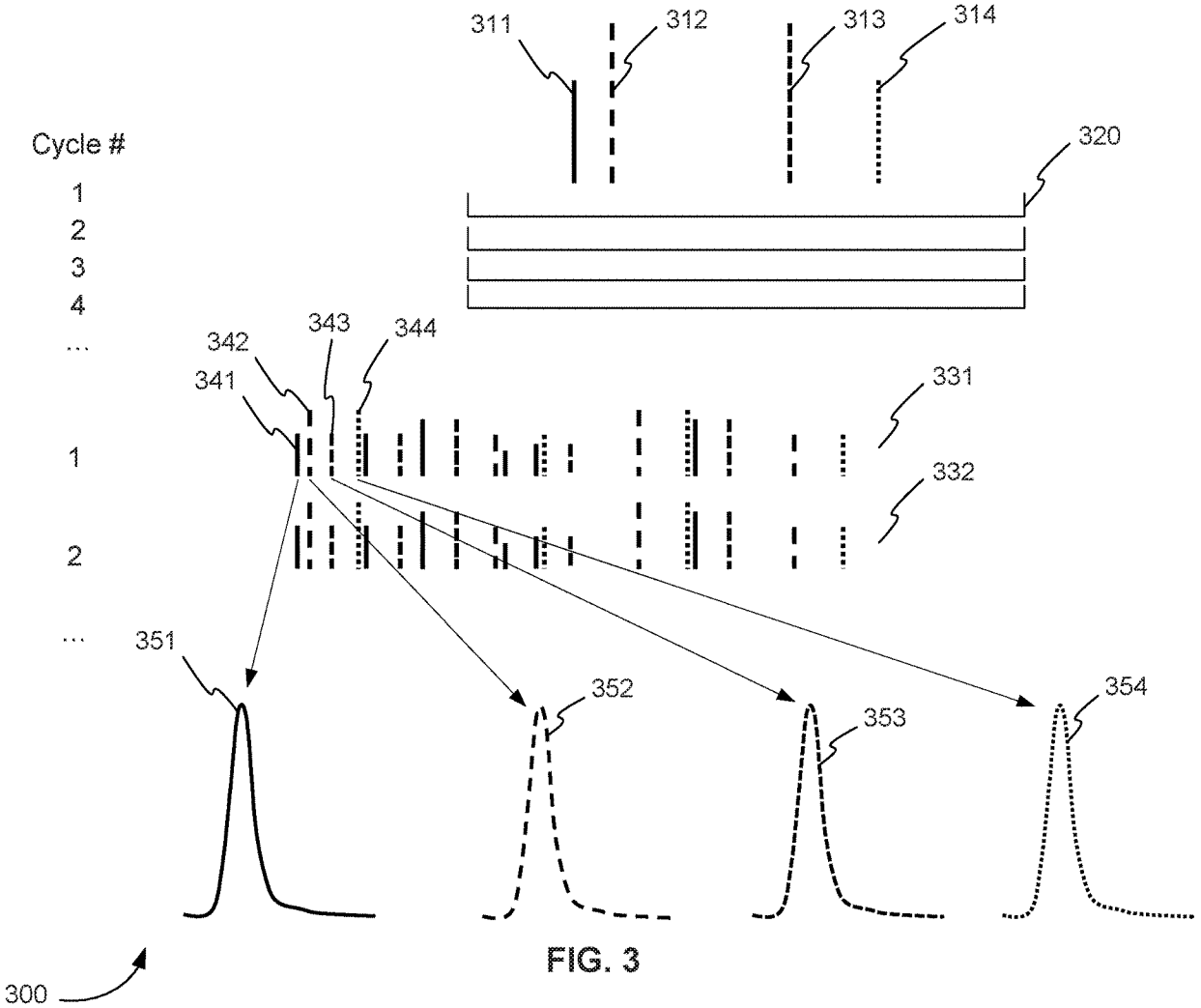
FIG. 3 is an exemplary diagram that graphically depicts the steps for obtaining product ion traces or extracted ion chromatograms (XICs) from the same precursor ion mass selection window of a SWATH™ acquisition method, and shows why it is difficult to deconvolve co-eluting products ions that are fragmented in the same precursor ion mass selection window, in accordance with various embodiments.

FIG. 3 is an exemplary diagram 300 that graphically depicts the steps for obtaining product ion traces or extracted ion chromatograms (XICs) from the same precursor ion mass selection window of a SWATH™ acquisition method, and shows why it is difficult to deconvolve co-eluting products ions that are fragmented in the same precursor ion mass selection window, in accordance with various embodiments. The sample of FIG. 3 includes four co-eluting precursor ions 311-314 that occur in the same precursor ion mass selection window 320. Precursor ion mass selection window 320 can be one of a plurality of precursor ion mass selection windows (not shown) that are selected and fragmented during each cycle of a plurality of cycles. FIG. 3 shows that precursor ion mass selection window 320 is selected and fragmented during each cycle of a plurality of cycles.

Each fragmentation of precursor ion mass selection window 320 during each cycle produces a product ion spectrum. FIG. 3 shows product ion spectrum 331 and product ion spectrum 332 obtained during cycles 1 and 2, respectively. Product ion spectra 331 and 332 show a variety of interspersed product ions of precursor ions 311-314. For example, product ion 341 is a product ion of precursor ion 311, product ion 342 is a product ion of precursor ion 312, product ion 343 is a product ion of precursor ion 313, and product ion 344 is a product ion of precursor ion 314.

Ion traces or XICs 351-354 are calculated from the measured intensities of product ions 341-344 from precursor ion mass selection window 320 over the plurality of cycles. XIC 351 is the ion trace of product ion 341, XIC 352 is the ion trace of product ion 342, XIC 353 is the ion trace of product ion 343, and XIC 354 is the ion trace of product ion 344.

Because precursor ions 311-314 are co-eluting, XICs 351-354 all have the same retention time. Also, as shown in FIG. 3, XICs 351-354 all have the same shape. As a result, it is not possible to determine the precursor ions from which XICs 351-354 were produced using shape and retention time. Further, if precursor ions 311-314 have product ions with the same or similar m/z value, it is not possible to identify convolved product ions from the XICs.

In various embodiments, product ions of different precursor ions are identified by changing precursor ion mass selection windows among cycles during SWATH™ acquisition. The change in precursor ion mass selection windows causes the ion traces of product ions of adjacent precursor ions to have different shapes. As a result, the precursor ions of the product ions can be determined.

In various embodiments, the precursor ion mass selection windows are shifted among cycles in a fixed pattern that is independent of any information on the location of precursor ions in any precursor ion mass selection window. The shifted pattern is determined before SWATH™ acquisition and does not change throughout the entire acquisition of the sample.

Figure 4:
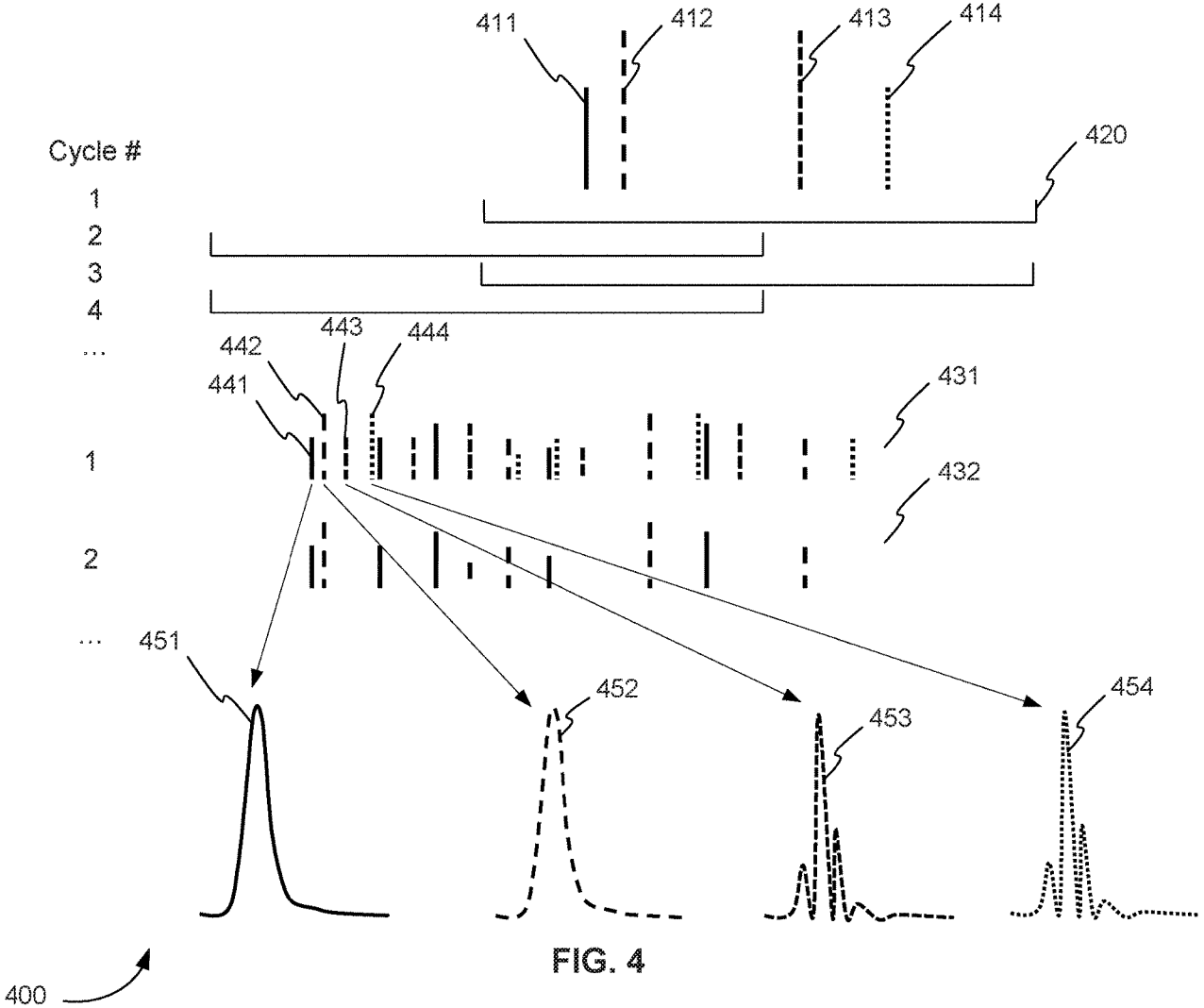
FIG. 4 is an exemplary diagram that graphically depicts the steps for obtaining product ion XICs from a shifted precursor ion mass selection window of a SWATH™ acquisition method, and shows how shifting a precursor ion mass selection window in a fixed pattern among cycles can be used to identify product ions with different precursor ions that are fragmented in the same precursor ion mass selection window, in accordance with various embodiments.

FIG. 4 is an exemplary diagram 400 that graphically depicts the steps for obtaining product ion XICs from a shifted precursor ion mass selection window of a SWATH™ acquisition method, and shows how shifting a precursor ion mass selection window in a fixed pattern among cycles can be used to identify product ions with different precursor ions that are fragmented in the same precursor ion mass selection window, in accordance with various embodiments. The sample of FIG. 4 includes four co-eluting precursor ions 411-414 that occur in the same precursor ion mass selection window 420. Precursor ion mass selection window 420 can be one of a plurality of precursor ion mass selection windows (not shown) that are selected and fragmented during each cycle of a plurality of cycles.

FIG. 4 shows that precursor ion mass selection window 420 is selected and fragmented during each cycle of a plurality of cycles. FIG. 4 also shows that precursor ion mass selection window 420 is shifted in m/z value by half of a window during every other cycle. For example, precursor ion mass selection window 420 is in a normal position in cycle 1. In cycle 2, precursor ion mass selection window 420 is shifted to the left in m/z value by half of the width of precursor ion mass selection window 420. In cycle 3, precursor ion mass selection window 420 is shifted back to the normal position. This shifting during every other cycle continues until the plurality of cycles is completed.

Each fragmentation of precursor ion mass selection window 420 during each cycle produces a product ion spectrum. FIG. 4 shows product ion spectrum 431 and product ion spectrum 432 obtained during cycles 1 and 2, respectively. Product ion spectra 431 and 432 show a variety of interspersed product ions of precursor ions 411-414. For example, product ion 441 is a product ion of precursor ion 411, product ion 442 is a product ion of precursor ion 412, product ion 443 is a product ion of precursor ion 413, and product ion 444 is a product ion of precursor ion 414.

The effect of shifting precursor ion mass selection window 420 is first seen by comparing product ion spectrum 431 and product ion spectrum 432. When precursor ion mass selection window 420 is shifted during every other cycle, precursor ions 413 and 414 are no longer fragmented in precursor ion mass selection window 420. As a result, for example, product ion spectrum 432 does not include the product ions of precursor ions 413 and 414. Specifically, intensities for the product ions 443 and 444 disappear in product ion spectrum 432 as compared to product ion spectrum 431.

Ion traces or XICs 451-454 are calculated from the measured intensities of product ions 441-444 from precursor ion mass selection window 420 over the plurality of cycles. XIC 451 is the ion trace of product ion 441, XIC 452 is the ion trace of product ion 442, XIC 453 is the ion trace of product ion 443, and XIC 454 is the ion trace of product ion 444.

The effect of shifting precursor ion mass selection window 420 is also apparent in XICs 453 and 454. Because the precursor ions of product ions 443 and 444 are not fragmented in precursor ion mass selection window 420 during every other cycle, XICs 453 and 454 have zero intensity during every other cycle. As a result, the shapes of XICs 453 and 454 are distorted in comparison to the shapes of XICs 451 and 452 and can be used to identify the precursor ions of product ions.

For example, product ions of precursor ion 411 can be distinguished from product ions of precursor ions 413 and 414 using fixed pattern shifting. However, product ions of precursor ion 411 cannot be distinguished from product ions of precursor ion 412, since precursor ion 411 always occurs with precursor ion 412 in precursor ion mass selection window 420, even after precursor ion mass selection window 420 is shifted. Consequently, fixed pattern shifting of precursor ion mass selection windows among cycles can help identify the precursor ions of some product ions.

In various embodiments, identification of precursor ions from product ions is further improved by dynamically shifting precursor ion mass selection window among cycles in SWATH™ acquisition. At run time, for example, information about the precursor ions in each precursor ion mass selection window is available. This information is then used to calculate how to shift the precursor ion mass selection windows among cycles. The precursor ion mass selection windows are shifted in order to ensure that at least one precursor ion in each precursor ion mass selection window remains in each precursor ion mass selection window during the shifting and the other precursor ions in each precursor ion mass selection window end up in at least one other precursor ion mass selection window during the shifting.

At run time, information about the precursor ions in each precursor ion mass selection window can be obtained from a precursor mass analysis of the precursor ion mass selection window, for example, from a low collision energy survey MS acquisition. Detected precursor ions are found from the precursor ion spectrum of the precursor ion mass selection window. The precursor ion mass selection windows are shifted, or changed in width, so as to ensure that at least some of the detected precursor ions are shifted from one precursor ion mass selection window to another. After several cycles (less than the width of a liquid chromatography (LC) peak) the majority of the eluting precursor ions are covered by a unique pattern of precursor ion mass selection windows. This dynamic adjustment of the shifting works even when the m/z difference between precursor ions is small.

Figure 5:
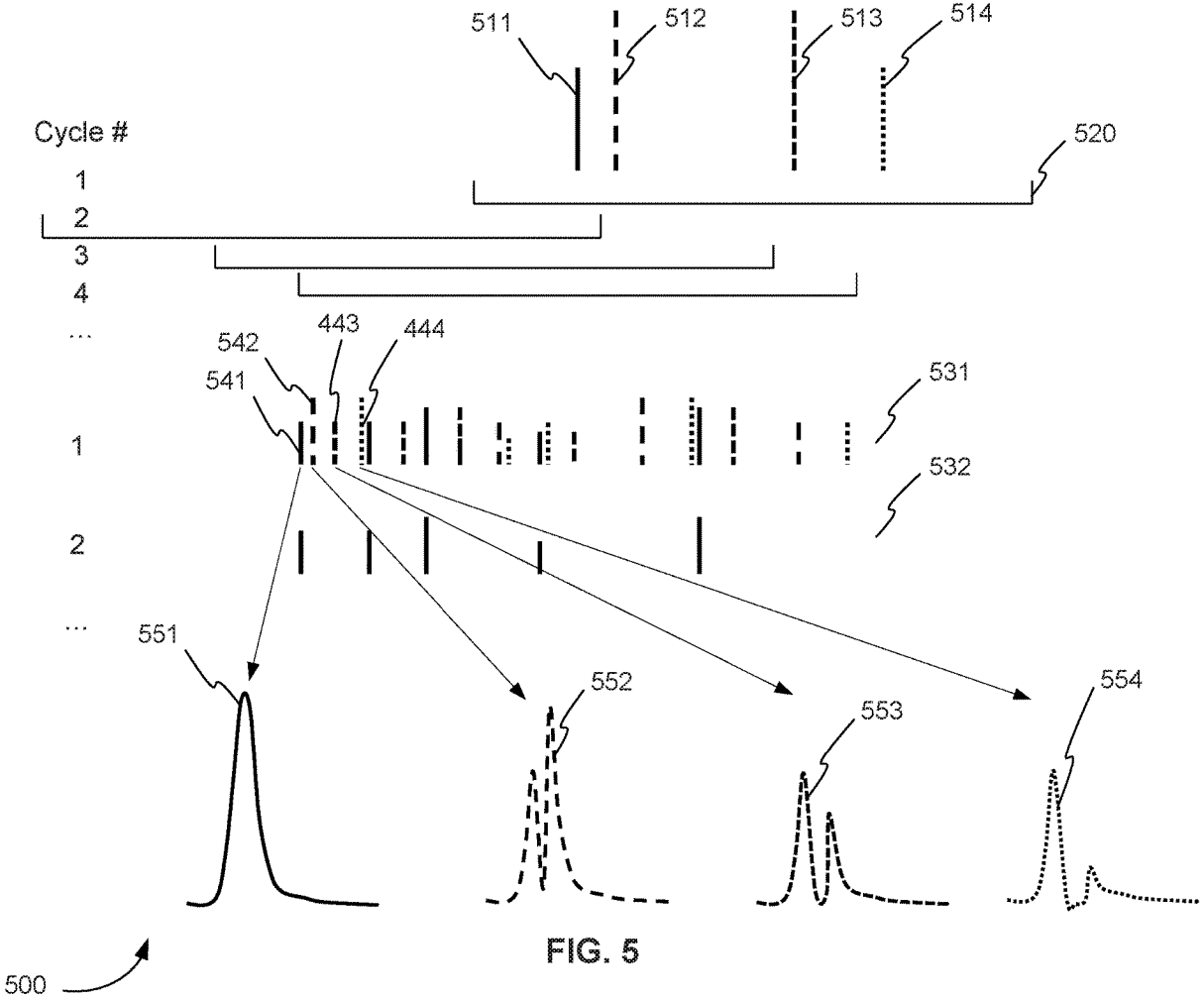
FIG. 5 is an exemplary diagram that graphically depicts the steps for obtaining product ion XICs from a shifted precursor ion mass selection window of a SWATH™ acquisition method, and shows how shifting a precursor ion mass selection window in a dynamic pattern among cycles can be used to identify product ions with different precursor ions that are fragmented in the same precursor ion mass selection window, in accordance with various embodiments.

FIG. 5 is an exemplary diagram 500 that graphically depicts the steps for obtaining product ion XICs from a shifted precursor ion mass selection window of a SWATH™ acquisition method, and shows how shifting a precursor ion mass selection window in a dynamic pattern among cycles can be used to identify product ions with different precursor ions that are fragmented in the same precursor ion mass selection window, in accordance with various embodiments. The sample of FIG. 5 includes four co-eluting precursor ions 511-514 that occur in the same precursor ion mass selection window 520. Precursor ion mass selection window 520 can be one of a plurality of precursor ion mass selection windows (not shown) that are selected and fragmented during each cycle of a plurality of cycles.

FIG. 5 shows that precursor ion mass selection window 520 is selected and fragmented during each cycle of a plurality of cycles. FIG. 5 also shows that precursor ion mass selection window 520 is shifted in m/z value in order to ensure that each of precursor ions 511-514 end up in a different precursor ion mass selection window at least once during the shifting process. For example, precursor ion mass selection window 520 is in a normal position in cycle 1 and includes precursor ions 511-514. In cycle 2, precursor ion mass selection window 520 is shifted to the left in m/z value in order to only include precursor ion 511 of precursor ions 511-514. In cycle 3, precursor ion mass selection window 520 is shifted to the left in m/z value in order to only include precursor ions 511 and 512 of precursor ions 511-514. In cycle 4, precursor ion mass selection window 520 is shifted to the left in m/z value in order to only include precursor ions 511, 512, and 513 of precursor ions 511-514. In cycle 5 (not shown), precursor ion mass selection window 520 is returned to the normal position, for example. This pattern of shifting continues until the plurality of cycles is completed.

Each fragmentation of precursor ion mass selection window 520 during each cycle produces a product ion spectrum. FIG. 5 shows product ion spectrum 531 and product ion spectrum 532 obtained during cycles 1 and 2, respectively. Product ion spectra 531 and 532 show a variety of interspersed product ions of precursor ions 511-514. For example, product ion 541 is a product ion of precursor ion 511, product ion 542 is a product ion of precursor ion 512, product ion 543 is a product ion of precursor ion 513, and product ion 544 is a product ion of precursor ion 514.

The effect of dynamically shifting precursor ion mass selection window 520 is first seen by comparing product ion spectrum 531 and product ion spectrum 532. When precursor ion mass selection window 520 is shifted in cycle 2, for example, precursor ions 512-514 are no longer fragmented in precursor ion mass selection window 520. As a result, product ion spectrum 532 does not include any product ions of precursor ions 512-514. Specifically, intensities for product ions 542-544 disappear in product ion spectrum 532 as compared to product ion spectrum 531.

Ion traces or XICs 551-554 are calculated from the measured intensities of product ions 341-344 from precursor ion mass selection window 520 over the plurality of cycles. XIC 551 is the ion trace of product ion 541, XIC 552 is the ion trace of product ion 542, XIC 553 is the ion trace of product ion 543, and XIC 554 is the ion trace of product ion 544.

The effect of dynamically shifting precursor ion mass selection window 520 is also apparent in XICs 552-554. Because the precursor ions of product ions 542-544 are not fragmented in precursor ion mass selection window 520 during at least one cycle, XICs 552-554 have zero intensity during that at least one cycle. As a result, the shapes of XICs 552-554 are distorted in comparison to the shape of XIC 551 and can be used to identify the precursor ions of product ions.

For example, product ions of precursor ion 511 can be distinguished from product ions of precursor ions 512-514 using dynamic pattern shifting. Consequently, dynamic pattern shifting of precursor ion mass selection windows among cycles can identify the precursor ions of all product ions.

In various embodiments, either fixed or dynamic pattern shifting is used to identify and deconvolve convolved product ions. When a measure product ion is convolved or shares contributions from two or more precursor ions, shifting the precursor ion mass selection windows can cause the XIC of the convolved product ion to oscillate between its measured intensity and an intensity of one of the deconvolved product ions. As a result, fixed or dynamic pattern shifting provides both a method of identifying convolved product ions and a method of deconvolving them.

Figure 6:
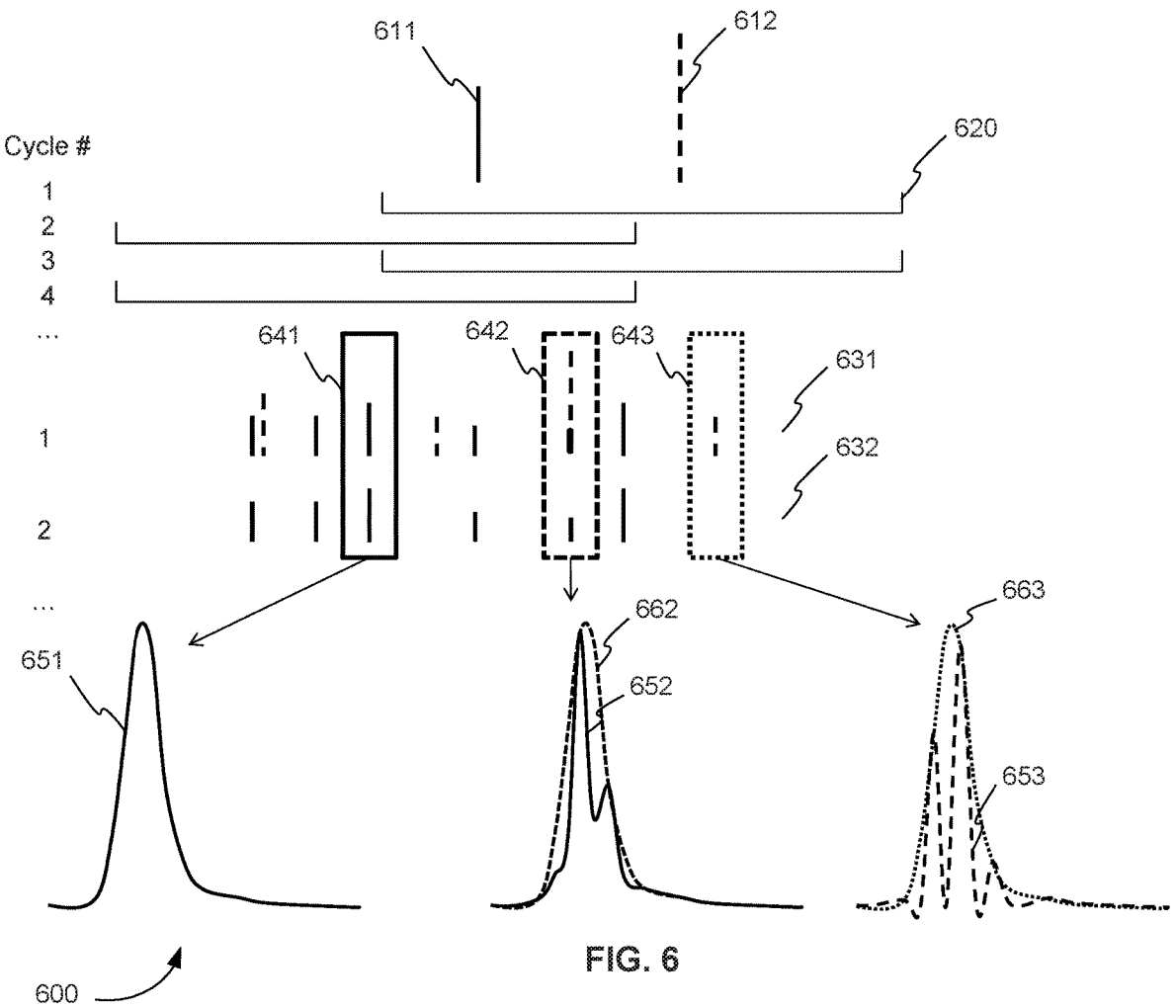
FIG. 6 is an exemplary diagram that graphically depicts the steps for obtaining product ion XICs from a shifted precursor ion mass selection window of a SWATH™ acquisition method, and shows how shifting a precursor ion mass selection window in a fixed pattern among cycles can be used to identify and deconvolve convolved product ions, in accordance with various embodiments.

FIG. 6 is an exemplary diagram 600 that graphically depicts the steps for obtaining product ion XICs from a shifted precursor ion mass selection window of a SWATH™ acquisition method, and shows how shifting a precursor ion mass selection window in a fixed pattern among cycles can be used to identify and deconvolve convolved product ions, in accordance with various embodiments. The sample of FIG. 6 includes two co-eluting precursor ions 611 and 612 that occur in the same precursor ion mass selection window 620. Precursor ion mass selection window 620 can be one of a plurality of precursor ion mass selection windows (not shown) that are selected and fragmented during each cycle of a plurality of cycles.

FIG. 6 shows that precursor ion mass selection window 620 is selected and fragmented during each cycle of a plurality of cycles. FIG. 6 also shows that precursor ion mass selection window 620 is shifted in m/z value by half of a window during every other cycle. For example, precursor ion mass selection window 620 is in a normal position in cycle 1. In cycle 2, precursor ion mass selection window 620 is shifted to the left in m/z value by half of the width of precursor ion mass selection window 620. In cycle 3, precursor ion mass selection window 620 is shifted back to the normal position. This shifting during every other cycle continues until the plurality of cycles is completed.

Each fragmentation of precursor ion mass selection window 620 during each cycle produces a product ion spectrum. FIG. 6 shows product ion spectrum 631 and product ion spectrum 632 obtained during cycles 1 and 2, respectively. Product ion spectra 631 and 632 show a variety of interspersed product ions of precursor ions 611 and 612.

The effect of shifting precursor ion mass selection window 620 is seen by comparing product ion spectrum 631 and product ion spectrum 632. When precursor ion mass selection window 620 is shifted during every other cycle, precursor ion 612 is no longer fragmented in precursor ion mass selection window 620. As a result, for example, product ion spectrum 632 does not include the product ions of precursor ion 612.

Three XICs 651-653 are calculated for three product ion m/z values 641-643, for example. XIC 651 has a peak shape that does not include any oscillations. Since precursor ion 611 is fragmented in every cycle and precursor ion 612 is fragmented in every other cycle, the peak shape of XIC 651 shows that the product ion at m/z value 641 belongs to precursor ion 611. XIC 653 has a peak shape that oscillates between a peak shape similar to the shape of XIC 651 (shown as shape outline 663) and zero. Again, since precursor ion 611 is fragmented in every cycle and precursor ion 612 is fragmented in every other cycle, the peak shape of XIC 653 shows that the product ion at m/z value 643 belongs to precursor ion 612.

XIC 652, however, has a peak shape that oscillates between a peak shape similar to the shape of XIC 651 (shown as shape outline 662) and a nonzero value. This oscillation between a peak shape similar to the shape of XIC 651 and a nonzero value implies that the product ion at m/z value 642 is convolved. Indeed, product ion spectrum 631 shows that in cycle 1 at m/z value 642 the measured intensity is the result of contributions from both precursor ions 611 and 612. However, product ion spectrum 632 shows that in cycle 2 at m/z value 642 the measured intensity is the result of a contribution from precursor ion 611 alone.

As a result, due to the shifting of precursor ion mass selection window 620, XIC 652 oscillates between the intensity of the convolved product ion of precursor ions 611 and 612 and the deconvolved product ion of precursor ion 611. Consequently, the shape of an XIC or ion trace can identify convolution by showing oscillation between a peak shape and a nonzero value. The shape of an XIC can also help deconvolve at least one of the product ions by providing information on the deconvolved intensity.

System for Providing Precursor Ion Information

Figure 7:
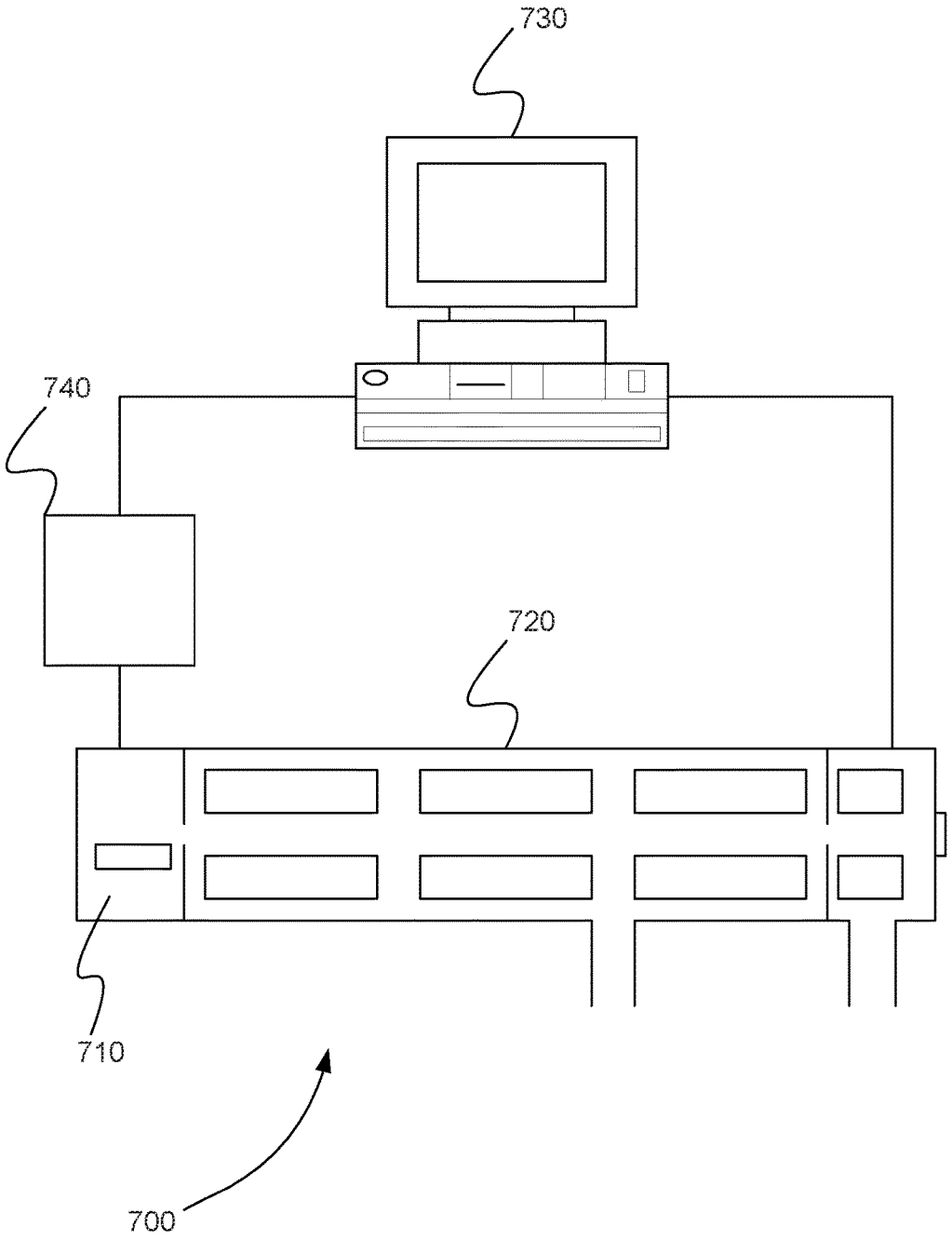
FIG. 7 is a schematic diagram of a system for providing precursor ion information in a tandem mass spectrometry DIA experiment by dynamically changing the m/z range of precursor ion mass section windows among cycles, in accordance with various embodiments.

FIG. 7 is a schematic diagram 700 of system for providing precursor ion information in a tandem mass spectrometry DIA experiment by dynamically changing the m/z range of precursor ion mass section windows among cycles, in accordance with various embodiments. System 700 includes ion source 710, tandem mass spectrometer 720, processor 730, and sample introduction device 740. Sample introduction device 740 can provide one or more compounds of a sample to ion source 710 using one of a variety of techniques. These techniques include, but are not limited to, gas chromatography (GC), liquid chromatography (LC), or capillary electrophoresis (CE).

Ion source 710 can be part of tandem mass spectrometer 720, or can be a separate device. Ion source 710 is configured to receive one or more compounds from sample introduction device 740 and ionize them, producing an ion beam of precursor ions.

Tandem mass spectrometer 720, for example, can include one or more physical mass filters and one or more physical mass analyzers. A mass analyzer of tandem mass spectrometer 720 can include, but is not limited to, a time-of-flight (TOF), quadrupole, an ion trap, a linear ion trap, an orbitrap, or a Fourier transform mass analyzer.

Tandem mass spectrometer 720 is configured to receive the ion beam and select and fragment an m/z range of the ion beam during each cycle of a plurality of cycles.

Processor 730 can be, but is not limited to, a computer, microprocessor, or any device capable of sending and receiving control signals and data from tandem mass spectrometer 720 and processing data. Processor 730 can be, for example, computer system 100 of FIG. 1. In various embodiments, processor 730 is in communication with tandem mass spectrometer 720 and sample introduction device 710.

Processor 730 divides the ion beam m/z range into two or more precursor ion mass selection windows. Each precursor ion mass selection window of the two or more precursor ion mass selection windows has an initial window m/z range corresponding to part of the ion beam m/z range. In various embodiments, the two or more precursor ion mass selection windows are fixed precursor ion mass selection windows. In various alternative embodiments, the two or more precursor ion mass selection windows are variable precursor ion mass selection windows or any combination of fixed and variable precursor ion mass selection windows. In addition, the two or more precursor ion mass selection windows can be overlapping, non-overlapping, or any combination of overlapping, non-overlapping precursor ion mass selection windows.

For at least one precursor ion mass selection window of the two or more precursor ion mass selection windows, processor 730 instructs the tandem mass spectrometer to perform a precursor ion survey scan mass analysis of the least one precursor ion mass selection window. A precursor ion mass spectrum that determines m/z values of precursor ions in the at least one precursor ion mass selection window is produced. This precursor ion survey scan mass analysis is performed at run time for each experiment. The precursor ion survey scan allows a pattern of window m/z ranges for the at least one precursor ion mass selection window to be determined dynamically.

Processor 730 determines a pattern of two or more different window m/z ranges to be used during two or more successive cycles for at least one precursor ion mass selection window of the two or more precursor ion mass selection windows. The pattern includes the initial window m/z range and one or more successively different window m/z ranges. Each of the one or more successively different window m/z ranges are chosen so that at least one precursor ion found in the precursor ion mass spectrum of the at least one precursor ion mass selection window remains in the at least one precursor ion mass selection window for all the one or more successively different window m/z ranges and the other precursor ions found in the precursor ion spectrum of the at least one precursor ion mass selection window end up in at least one other precursor ion mass selection window for at least one of the one or more successively different window m/z ranges.

Processor 730 instructs the tandem mass spectrometer to select and fragment the two or more precursor ion mass selection windows during each cycle of the plurality of cycles. A product ion spectrum for each precursor ion mass selection window of the two or more precursor ion mass selection windows is produced for each cycle. Processor 730 instructs the tandem mass spectrometer to repeatedly use the pattern of two or more different window m/z ranges for each group of two or more successive cycles of the plurality of cycles for the selection and fragmentation of the at least one precursor ion mass selection window. Product ion spectra are produced for the at least one precursor ion mass selection window that include an effect of the repeated use of the pattern.

In various embodiments, the one or more successively different window m/z ranges of the at least one precursor ion mass selection window are produced by shifting the initial window m/z range within the ion beam m/z range as shown in FIG. 5. In other words, the initial window m/z range is shifted within the ion beam m/z range so that the at least one precursor ion found in the precursor ion mass spectrum of the at least one precursor ion mass selection window remains in the at least one precursor ion mass selection window for all the one or more successively different window m/z ranges and the other precursor ions found in the precursor ion spectrum of the at least one precursor ion mass selection window end up in at least one other precursor ion mass selection window for at least one of the one or more successively different window m/z ranges.

In various embodiments, the one or more successively different window m/z ranges of the at least one precursor ion mass selection window are produced by changing the m/z width of the at least one precursor ion mass selection window.

Figure 8:
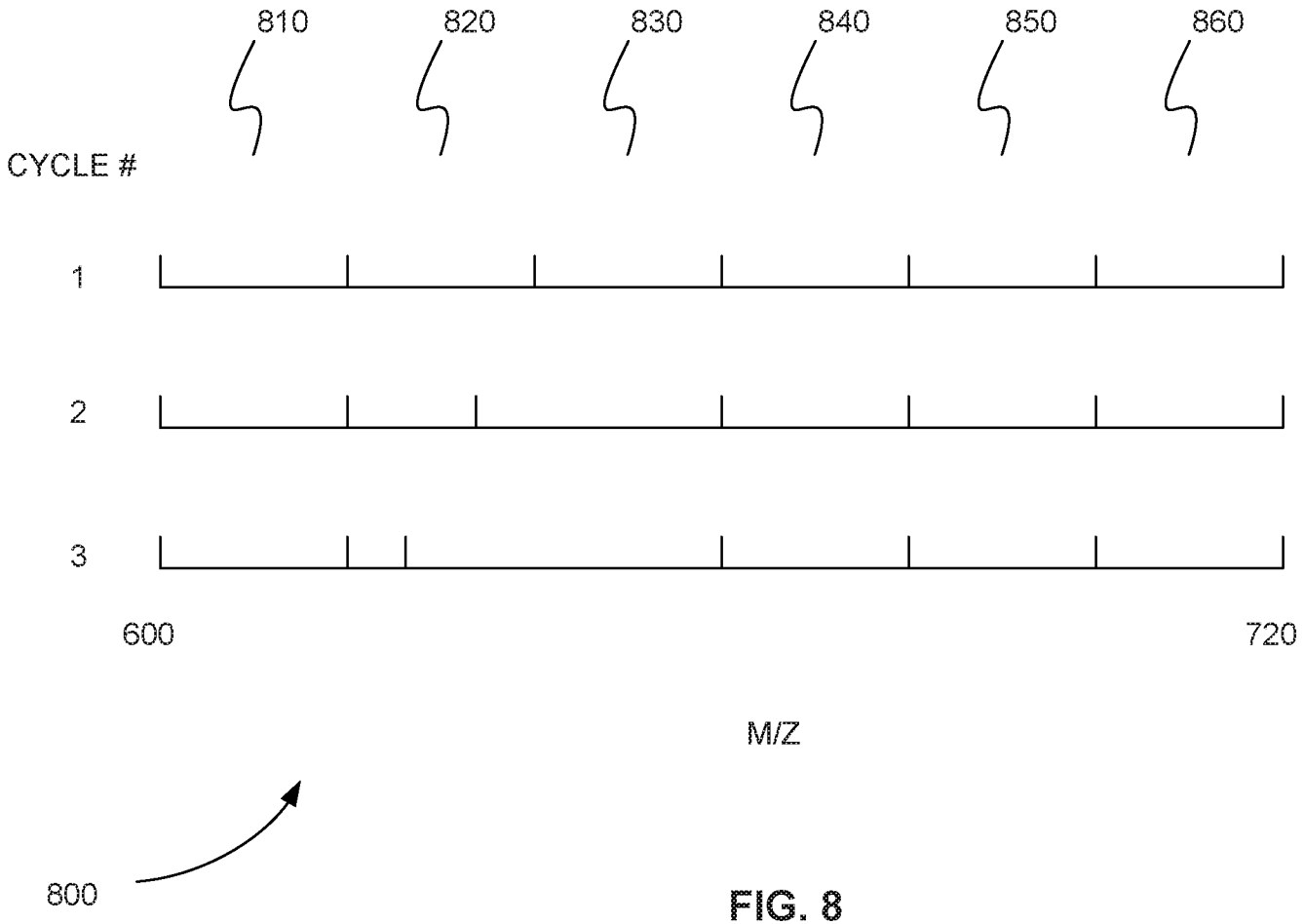
FIG. 8 is an exemplary diagram of the successively different window m/z ranges of a precursor ion mass selection window produced by changing the m/z width of the precursor ion mass selection window, in accordance with various embodiments.

FIG. 8 is an exemplary diagram 800 of the successively different window m/z ranges of a precursor ion mass selection window produced by changing the m/z width of the precursor ion mass selection window, in accordance with various embodiments. Ion beam m/z range from 600 to 720 m/z is divided into six precursor ion mass selection windows 810-860. The m/z width of precursor ion mass selection window 820 is successively decreased in cycles 2 and 3, for example, to provide successively different window m/z ranges for precursor ion mass selection window 820 in cycles 2 and 3.

Returning to FIG. 7 and in various embodiments, processor 730 successively changes in the m/z width of the at least one precursor ion mass selection window so that the at least one precursor ion found in the precursor ion mass spectrum of the at least one precursor ion mass selection window remains in the at least one precursor ion mass selection window for all the one or more successively different window m/z ranges and the other precursor ions found in the precursor ion spectrum of the at least one precursor ion mass selection window end up in at least one other precursor ion mass selection window for at least one of the one or more successively different window m/z ranges.

More specifically, in various embodiments processor 730 successively decreases the m/z width of the at least one precursor ion mass selection window so that the at least one precursor ion found in the precursor ion mass spectrum of the at least one precursor ion mass selection window remains in the at least one precursor ion mass selection window for all the one or more successively different window m/z ranges and the other precursor ions found in the precursor ion spectrum of the at least one precursor ion mass selection window end up in at least one other precursor ion mass selection window for at least one of the one or more successively different window m/z ranges.

Returning to FIG. 8, as the m/z width of precursor ion mass selection window 820 is successively decreased, the width of precursor ion mass selection window 830 is successively increased in order to maintain analysis of the entire ion beam m/z range from 600 to 720 m/z. As a result, when the window m/z range of one precursor ion mass selection window is changed, the window m/z ranges of one or more other precursor ion mass selection windows can also be changed.

Returning to FIG. 7 and in various embodiments, processor 730 further for each precursor ion mass selection window of the one or more other precursor ion mass selection windows, instructs the tandem mass spectrometer to perform a precursor ion survey scan mass analysis of the each precursor ion mass selection window. A precursor ion mass spectrum that determines m/z values of precursor ions in each precursor ion mass selection window is produced. A plurality of precursor ion mass spectra are produced for the one or more other precursor ion mass selection windows.

Processor 730 then changes window m/z ranges for one or more other precursor ion mass selection windows of the two or more precursor ion mass selection windows during the two or more successive cycles in order analyze the entire ion beam m/z range during every cycle of the plurality of cycles. For example, processor 730 further determines one or more additional patterns of two or more different window m/z ranges to be used during the two or more successive cycles for one or more other precursor ion mass selection windows of the two or more precursor ion mass selection windows. Each of the one or more successively different window m/z ranges are chosen so that at least one precursor ion found in the precursor ion mass spectrum of each precursor ion mass selection window remains in each precursor ion mass selection window for all the one or more successively different window m/z ranges and the other precursor ions found in the precursor ion spectrum of each precursor ion mass selection window end up in at least one other precursor ion mass selection window for at least one of the one or more successively different window m/z ranges, producing one or more additional patterns.

Processor 730 instructs the tandem mass spectrometer to repeatedly use the one or more additional patterns of two or more different window m/z ranges during each cycle of the two or more successive cycles for the selection and fragmentation of the one or more other precursor ion mass selection windows. Product ion spectra are produced for each precursor ion mass selection window of the one or more other precursor ion mass selection windows that include an effect of the repeated use of the one or more additional patterns.

In various embodiments, processor 730 further calculates a product ion trace for each product ion of the product ion spectra produced over the plurality of cycles for the at least one precursor ion mass selection window, producing a plurality of product ion traces. Processor 730 further identifies product ions of the at least one precursor ion mass selection window that have product ion traces that exhibit intensity peaks that include intensity values that oscillate between an expected peak shape value and zero. Processor 730 identifies these product ions as product ions of one or more precursor ions that do not have an m/z value within the portion of the initial window m/z range that remains in the one or more successively different window m/z ranges of the at least one precursor ion mass selection window. For example, in FIG. 4, product ion traces 453 and 454 exhibit intensity peaks that include intensity values that oscillate between an expected peak shape value and zero. As a result, the product ions represented by product ion traces 453 and 454 are determined to be product ions of precursor ions in a portion of precursor ion mass selection window 420 that does not remain in precursor ion mass selection window 420 as precursor ion mass selection window 420 is shifted.

Returning to FIG. 7 and various embodiments, processor 730 further identifies product ions of the at least one precursor ion mass selection window that have product ion traces that exhibit intensity peaks that include intensity values that oscillate between an expected peak shape value and a nonzero non-peak shape value. Processor 730 identifies these product ions as convolved product ions. These convolved product ions include intensity contributions from both one or more precursor ions that do not have an m/z value within the portion of the initial window m/z range that remains in the one or more successively different window m/z ranges of the at least one precursor ion mass selection window and one or more precursor ions that have an m/z value within the portion of the initial window m/z range.

For example, in FIG. 6, product ion trace 652 is an intensity peak that includes intensity values that oscillate between an expected peak shape value 662 and a nonzero non-peak shape value. The product ion represented by product ion trace 652 is, therefore, a convolved product ion. The convolved product ion includes intensity contributions from both precursor ions 611 and 612. Precursor ion 611 has an m/z value within the portion of the initial window m/z range of precursor ion mass selection window 620 that remains in the one or more successively different window m/z ranges of precursor ion mass selection window 620, and precursor ion 612 has an m/z value within the portion of the initial window m/z range of precursor ion mass selection window 620 that does not remain in the one or more successively different window m/z ranges of precursor ion mass selection window 620.

Returning to FIG. 7, processor 730 further deconvolves convolved product ions. Processor 730 further deconvolves convolved product ions by determining that a collection of nonzero non-peak shape values of a product ion trace of each convolved product ion of the convolved product ions correspond to contributions from one or more precursor ions that do not have an m/z value within the portion of the initial window m/z range.

For example, again with reference to FIG. 6, the product ion represented by product ion trace 652 is deconvolved by determining that the collection of nonzero non-peak shape values of product ion trace 652 correspond to contributions from precursor ion 611, which has an m/z value within the portion of the initial window m/z range that does not change as precursor ion mass selection window 620 is changed.

Returning to FIG. 7, processor 730 further subtracts the collection of nonzero non-peak shape values of the product ion trace from the expected peak shape values of the product ion trace of each convolved product ion of the convolved product ions in order to determine contributions from one or more precursor ions that do not have an m/z value within the portion of the initial window m/z range. For example, again with reference to FIG. 6, the collection of nonzero non-peak shape values of product ion trace 652 are subtracted from expected peak shape values 662 of product ion trace 652 of each convolved product ion of the convolved product ions in order to determine contributions from precursor ion 612, which does not have an m/z value within the portion of the initial window m/z range that does not change as precursor ion mass selection window 620 is changed.

Method for Providing Precursor Ion Information

Figure 9:
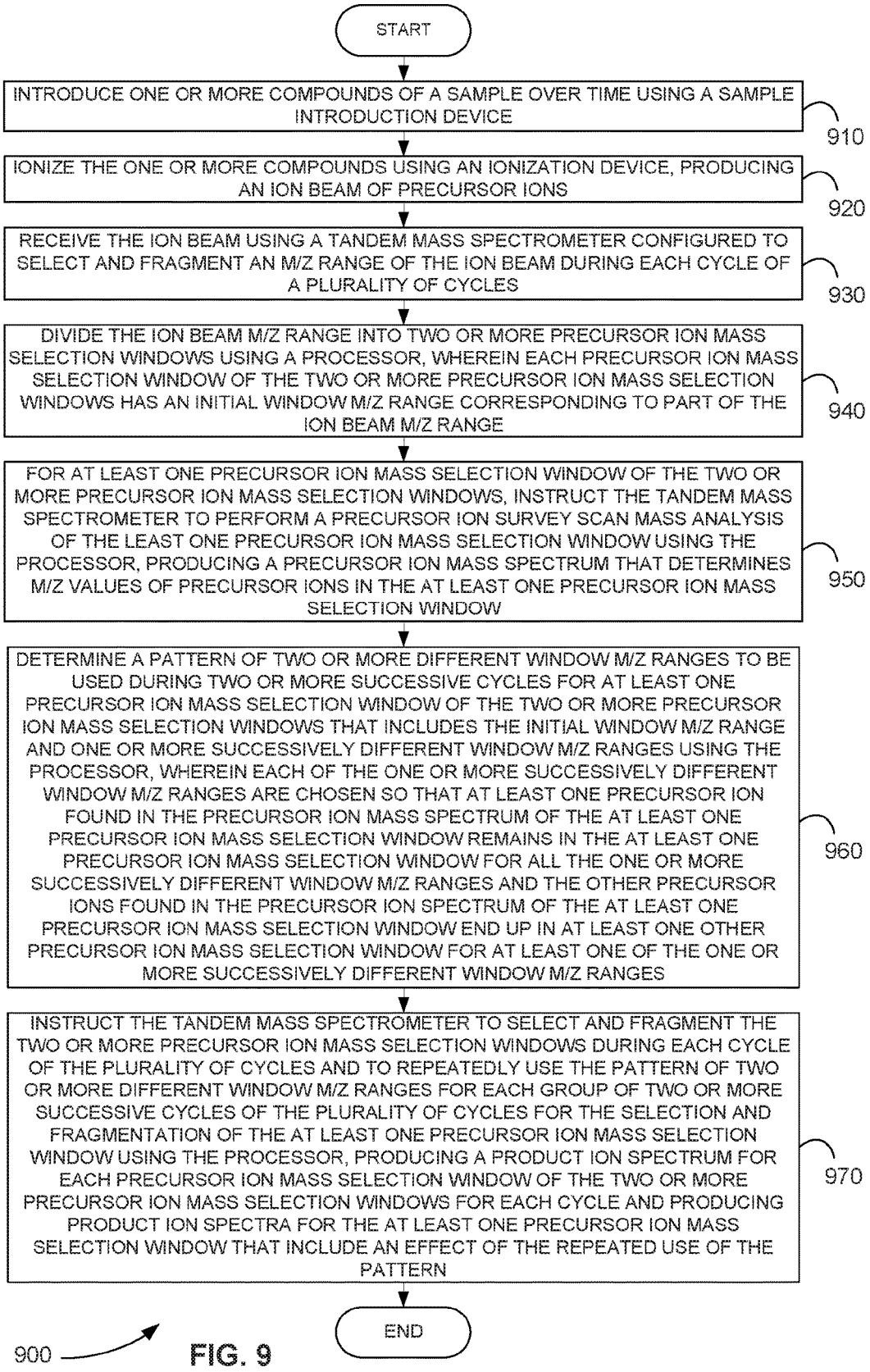
FIG. 9 is a flowchart showing a method for providing precursor ion information in a tandem mass spectrometry DIA experiment by dynamically changing the m/z range of precursor ion mass section windows among cycles, in accordance with various embodiments.

FIG. 9 is a flowchart showing a method 900 for providing precursor ion information in a tandem mass spectrometry DIA experiment by dynamically changing the m/z range of precursor ion mass section windows among cycles, in accordance with various embodiments.

In step 910 of method 900, one or more compounds of a sample are introduced over time using a sample introduction device.

In step 920, the one or more compounds are ionized using an ionization device, producing an ion beam of precursor ions.

In step 930, the ion beam is received using a tandem mass spectrometer configured to select and fragment an m/z range of the ion beam during each cycle of a plurality of cycles.

In step 940, the ion beam m/z range is divided into two or more precursor ion mass selection windows using a processor. Each precursor ion mass selection window of the two or more precursor ion mass selection windows has an initial window m/z range corresponding to part of the ion beam m/z range.

In step 950, for at least one precursor ion mass selection window of the two or more precursor ion mass selection windows, the tandem mass spectrometer is instructed to perform a precursor ion survey scan mass analysis of the least one precursor ion mass selection window using the processor. A precursor ion mass spectrum that determines m/z values of precursor ions in the at least one precursor ion mass selection window is produced.

In step 960, a pattern of two or more different window m/z ranges to be used during two or more successive cycles for at least one precursor ion mass selection window of the two or more precursor ion mass selection windows is determined using the processor. The pattern includes the initial window m/z range and one or more successively different window m/z ranges. Each of the one or more successively different window m/z ranges are chosen so that at least one precursor ion found in the precursor ion mass spectrum of the at least one precursor ion mass selection window remains in the at least one precursor ion mass selection window for all the one or more successively different window m/z ranges and the other precursor ions found in the precursor ion spectrum of the at least one precursor ion mass selection window end up in at least one other precursor ion mass selection window for at least one of the one or more successively different window m/z ranges.

In step 970, the tandem mass spectrometer is instructed to select and fragment the two or more precursor ion mass selection windows during each cycle of the plurality of cycles using the processor. The tandem mass spectrometer is also instructed to repeatedly use the pattern of two or more different window m/z ranges for each group of two or more successive cycles of the plurality of cycles for the selection and fragmentation of the at least one precursor ion mass selection window using the processor. A product ion spectrum is produced for each precursor ion mass selection window of the two or more precursor ion mass selection windows for each cycle. Product ion spectra are produced for the at least one precursor ion mass selection window that include an effect of the repeated use of the pattern.

Computer Program Product for Providing Precursor Ion Information

In various embodiments, computer program products include a tangible computer-readable storage medium whose contents include a program with instructions being executed on a processor so as to perform a method for providing precursor ion information in a tandem mass spectrometry DIA experiment by dynamically changing the m/z range of precursor ion mass section windows among cycles. This method is performed by a system that includes one or more distinct software modules.

Figure 10:
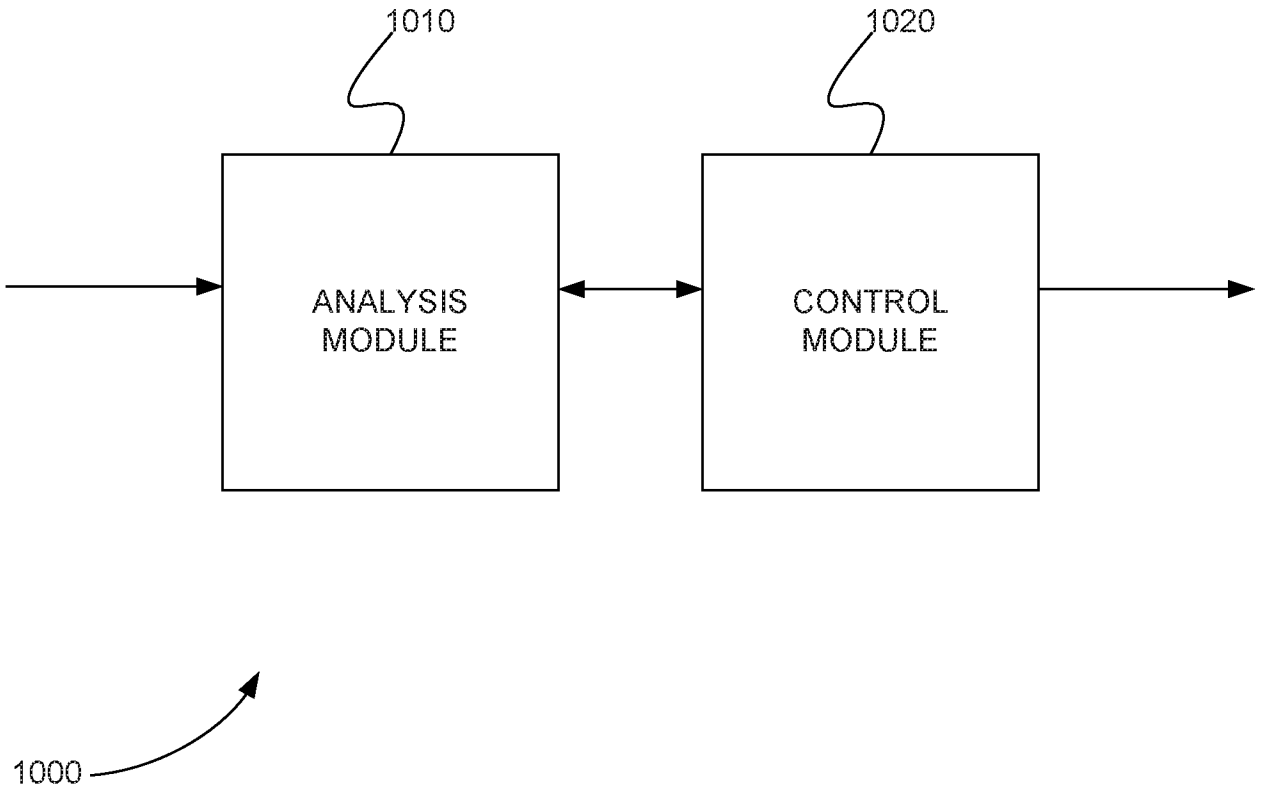
FIG. 10 is a schematic diagram of a system that includes one or more distinct software modules that performs a method for providing precursor ion information in a tandem mass spectrometry DIA experiment by dynamically changing the m/z range of precursor ion mass section windows among cycles, in accordance with various embodiments.

FIG. 10 is a schematic diagram of a system 1000 that includes one or more distinct software modules that performs a method for providing precursor ion information in a tandem mass spectrometry DIA experiment by dynamically changing the m/z range of precursor ion mass section windows among cycles, in accordance with various embodiments. System 1000 includes analysis module 1010 and control modules 1020.

Analysis module 1010 receives an m/z range of an ion beam of precursor ions. The ion beam is received by a tandem mass spectrometer configured to select and fragment the ion beam m/z range during each cycle of a plurality of cycles. The ion beam is produced by an ionization device that receives and ionizes one or more compounds of a sample. The one or more compounds are produced by a sample introduction device that introduces one or more compounds of a sample over time.

Analysis module 1010 divides the ion beam m/z range into two or more precursor ion mass selection windows. Each precursor ion mass selection window of the two or more precursor ion mass selection windows has an initial window m/z range corresponding to part of the ion beam m/z range.

For at least one precursor ion mass selection window of the two or more precursor ion mass selection windows, control module 1020 instructs the tandem mass spectrometer to perform a precursor ion survey scan mass analysis of the least one precursor ion mass selection window. A precursor ion mass spectrum that determines m/z values of precursor ions in the at least one precursor ion mass selection window is produced.

Analysis module 1010 determines a pattern of two or more different window m/z ranges to be used during two or more successive cycles for at least one precursor ion mass selection window of the two or more precursor ion mass selection windows. The pattern includes the initial window m/z range and one or more successively different window m/z ranges. Each of the one or more successively different window m/z ranges are chosen so that at least one precursor ion found in the precursor ion mass spectrum of the at least one precursor ion mass selection window remains in the at least one precursor ion mass selection window for all the one or more successively different window m/z ranges and the other precursor ions found in the precursor ion spectrum of the at least one precursor ion mass selection window end up in at least one other precursor ion mass selection window for at least one of the one or more successively different window m/z ranges.

Control module 1020 instructs the tandem mass spectrometer to select and fragment the two or more precursor ion mass selection windows during each cycle of the plurality of cycles. Control module 1020 also instructs the tandem mass spectrometer to repeatedly use the pattern of two or more different window m/z ranges for each group of two or more successive cycles of the plurality of cycles for the selection and fragmentation of the at least one precursor ion mass selection window. A product ion spectrum is produced for each precursor ion mass selection window of the two or more precursor ion mass selection windows for each cycle. Product ion spectra are produced for the at least one precursor ion mass selection window that include an effect of the repeated use of the pattern.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for providing precursor ion information in a tandem mass spectrometry data independent acquisition (DIA) experiment by changing the mass-to-charge ratio (m/z) range of precursor ion mass section windows among cycles, comprising:

a sample introduction device that introduces one or more compounds of a sample over time;

an ion source configured to receive the one or more compounds from the sample introduction device and ionize the one or more compounds, producing an ion beam of precursor ions;

a tandem mass spectrometer configured to receive the ion beam of precursor ions and select and fragment an m/z range of the ion beam during each cycle of a plurality of cycles; and a processor in communication with the tandem mass spectrometer that (a) divides the ion beam m/z range into two or more precursor ion mass selection windows, wherein each precursor ion mass selection window of the two or more precursor ion mass selection windows has an initial window m/z range corresponding to part of the ion beam m/z range, (b) for at least one precursor ion mass selection window of the two or more precursor ion mass selection windows, instructs the tandem mass spectrometer to perform a precursor ion survey scan mass analysis of the least one precursor ion mass selection window, producing a precursor ion mass spectrum that determines m/z values of precursor ions in the at least one precursor ion mass selection window, (c) determines a pattern of two or more different window m/z ranges to be used during two or more successive cycles for at the least one precursor ion mass selection window that includes an initial window m/z range and one or more successively different window m/z ranges, wherein each of the one or more successively different window m/z ranges are chosen so that at least one precursor ion found in the precursor ion mass spectrum of the at least one precursor ion mass selection window remains in the at least one precursor ion mass selection window for all the one or more successively different window m/z ranges and the other precursor ions found in the precursor ion spectrum of the at least one precursor ion mass selection window end up in at least one other precursor ion mass selection window for at least one of the one or more successively different window m/z ranges, and (d) instructs the tandem mass spectrometer to select and fragment the two or more precursor ion mass selection windows during each cycle of the plurality of cycles and to repeatedly use the pattern of two or more different window m/z ranges for each group of two or more successive cycles of the plurality of cycles for the selection and fragmentation of the at least one precursor ion mass selection window, producing a product ion spectrum for each precursor ion mass selection window of the two or more precursor ion mass selection windows for each cycle and producing product ion spectra for the at least one precursor ion mass selection window that include an effect of the repeated use of the pattern.

2. The system of claim 1, wherein one or more successively different window m/z ranges chosen comprise shifts of the initial window m/z range within the ion beam m/z range so that the at least one precursor ion found in the precursor ion mass spectrum of the at least one precursor ion mass selection window remains in the at least one precursor ion mass selection window for all the one or more successively different window m/z ranges and the other precursor ions found in the precursor ion spectrum of the at least one precursor ion mass selection window end up in at least one other precursor ion mass selection window for at least one of the one or more successively different window m/z ranges.

3. The system of claim 1, wherein the one or more successively different window m/z ranges chosen comprise successive changes in the m/z width of the at least one precursor ion mass selection window so that the at least one precursor ion found in the precursor ion mass spectrum of the at least one precursor ion mass selection window remains in the at least one precursor ion mass selection window for all the one or more successively different window m/z ranges and the other precursor ions found in the precursor ion spectrum of the at least one precursor ion mass selection window end up in at least one other precursor ion mass selection window for at least one of the one or more successively different window m/z ranges.

4. The system of claim 3, wherein the successive changes in the m/z width of the at least one precursor ion mass selection window comprise decreases the m/z width of the at least one precursor ion mass selection window so that the at least one precursor ion found in the precursor ion mass spectrum of the at least one precursor ion mass selection window remains in the at least one precursor ion mass selection window for all the one or more successively different window m/z ranges and the other precursor ions found in the precursor ion spectrum of the at least one precursor ion mass selection window end up in at least one other precursor ion mass selection window for at least one of the one or more successively different window m/z ranges.

5. The system of claim 1, wherein the processor further changes window m/z ranges for one or more other precursor ion mass selection windows of the two or more precursor ion mass selection windows during the two or more successive cycles in order analyze the entire ion beam m/z range during every cycle of the plurality of cycles by during step (b), for each precursor ion mass selection window of the one or more other precursor ion mass selection windows, instructing the tandem mass spectrometer to perform a precursor ion survey scan mass analysis of the each precursor ion mass selection window, producing a precursor ion mass spectrum that determines m/z values of precursor ions in the each precursor ion mass selection window and a plurality of precursor ion mass spectra for the one or more other precursor ion mass selection windows, during step (c), for each precursor ion mass selection window of the one or more other precursor ion mass selection windows, determining a pattern of two or more different window m/z ranges to be used during two or more successive cycles for the each precursor ion mass selection window that includes an initial window m/z range and one or more successively different window m/z ranges, wherein each of the one or more successively different window m/z ranges are chosen so that at least one precursor ion found in the precursor ion mass spectrum of the each precursor ion mass selection window remains in the each precursor ion mass selection window for all the one or more successively different window m/z ranges and the other precursor ions found in the precursor ion spectrum of the each precursor ion mass selection window end up in at least one other precursor ion mass selection window for at least one of the one or more successively different window m/z ranges, producing one or more additional patterns, and during step (d), instructing the tandem mass spectrometer to repeatedly use the one or more additional patterns of two or more different window m/z ranges during each cycle of the two or more successive cycles for the selection and fragmentation of the one or more other precursor ion mass selection windows, producing product ion spectra for each precursor ion mass selection window of the one or more other precursor ion mass selection windows that include an effect of the repeated use of the one or more additional patterns.

6. The system of claim 5, wherein one or more successively different window m/z ranges chosen comprise shifts of the initial window m/z range within the ion beam m/z range so that the at least one precursor ion found in the precursor ion mass spectrum of the each precursor ion mass selection window remains in the each precursor ion mass selection window for all the one or more successively different window m/z ranges and the other precursor ions found in the precursor ion spectrum of the each precursor ion mass selection window end up in at least one other precursor ion mass selection window for at least one of the one or more successively different window m/z ranges.

7. The system of claim 5, wherein the one or more successively different window m/z ranges chosen comprise successive changes in the m/z width of the each precursor ion mass selection window so that the at least one precursor ion found in the precursor ion mass spectrum of the each precursor ion mass selection window remains in the each precursor ion mass selection window for all the one or more successively different window m/z ranges and the other precursor ions found in the precursor ion spectrum of the each precursor ion mass selection window end up in at least one other precursor ion mass selection window for at least one of the one or more successively different window m/z ranges.

8. The system of claim 7, wherein the successive changes in the m/z width of the each precursor ion mass selection window comprise decreases the m/z width of the each precursor ion mass selection window so that the at least one precursor ion found in the precursor ion mass spectrum of the each precursor ion mass selection window remains in the each precursor ion mass selection window for all the one or more successively different window m/z ranges and the other precursor ions found in the precursor ion spectrum of the each precursor ion mass selection window end up in at least one other precursor ion mass selection window for at least one of the one or more successively different window m/z ranges.

9. The system of claim 1, wherein the processor further calculates a product ion trace for each product ion of the product ion spectra produced over the plurality of cycles for the at least one precursor ion mass selection window, producing a plurality of product ion traces.

10. The system of claim 7, wherein the processor further identifies product ions of the at least one precursor ion mass selection window that have product ion traces that exhibit intensity peaks that include intensity values that oscillate between an expected peak shape value and zero as product ions of one or more precursor ions that do not have an m/z value within the portion of the initial window m/z range that remains in the one or more successively different window m/z ranges of the at least one precursor ion mass selection window.

11. The system of claim 7, wherein the processor further identifies product ions of the at least one precursor ion mass selection window that have product ion traces that exhibit intensity peaks that include intensity values that oscillate between an expected peak shape value and a nonzero non-peak shape value as convolved product ions that include intensity contributions from both one or more precursor ions that do not have an m/z value within the portion of the initial window m/z range that remains in the one or more successively different window m/z ranges of the at least one precursor ion mass selection window and one or more precursor ions that have an m/z value within the portion of the initial window m/z range.

12. The system of claim 9, wherein the processor further deconvolves the convolved product ions by determining that a collection of nonzero non-peak shape values of a product ion trace of each convolved product ion of the convolved product ions correspond to contributions from one or more precursor ions that have an m/z value within the portion of the initial window m/z range.

13. The system of claim 10, wherein the processor further subtracts the collection of nonzero non-peak shape values of the product ion trace from the expected peak shape values of the product ion trace of each convolved product ion of the convolved product ions in order to determine contributions from one or more precursor ions that do not have an m/z value within the portion of the initial window m/z range.

14. A method for providing precursor ion information in a tandem mass spectrometry data independent acquisition (DIA) experiment by changing the mass-to charge ratio (m/z) range of precursor ion mass section windows among cycles, comprising:

introducing one or more compounds of a sample over time using a sample introduction device;

ionizing the one or more compounds using an ionization device, producing an ion beam of precursor ions;

receiving the ion beam using a tandem mass spectrometer configured to select and fragment an m/z range of the ion beam during each cycle of a plurality of cycles;

dividing the ion beam m/z range into two or more precursor ion mass selection windows using a processor, wherein each precursor ion mass selection window of the two or more precursor ion mass selection windows has an initial window m/z range corresponding to part of the ion beam m/z range;

for at least one precursor ion mass selection window of the two or more precursor ion mass selection windows, instructing the tandem mass spectrometer to perform a precursor ion survey scan mass analysis of the least one precursor ion mass selection window using the processor, producing a precursor ion mass spectrum that determines m/z values of precursor ions in the at least one precursor ion mass selection window;

determining a pattern of two or more different window m/z ranges to be used during two or more successive cycles for at least one precursor ion mass selection window of the two or more precursor ion mass selection windows that includes the initial window m/z range and one or more successively different window m/z ranges using the processor, wherein each of the one or more successively different window m/z ranges are chosen so that at least one precursor ion found in the precursor ion mass spectrum of the at least one precursor ion mass selection window remains in the at least one precursor ion mass selection window for all the one or more successively different window m/z ranges and the other precursor ions found in the precursor ion spectrum of the at least one precursor ion mass selection window end up in at least one other precursor ion mass selection window for at least one of the one or more successively different window m/z ranges; and instructing the tandem mass spectrometer to select and fragment the two or more precursor ion mass selection windows during each cycle of the plurality of cycles and to repeatedly use the pattern of two or more different window m/z ranges for each group of two or more successive cycles of the plurality of cycles for the selection and fragmentation of the at least one precursor ion mass selection window using the processor, producing a product ion spectrum for each precursor ion mass selection window of the two or more precursor ion mass selection windows for each cycle and producing product ion spectra for the at least one precursor ion mass selection window that include an effect of the repeated use of the pattern.

15. A computer program product, comprising a non-transitory and tangible computer-readable storage medium whose contents include a program with instructions being executed on a processor so as to perform a method for providing precursor ion information in a tandem mass spectrometry data independent acquisition (DIA) experiment by changing the mass-to charge ratio (m/z) range of precursor ion mass section windows among cycles, comprising:

providing a system, wherein the system comprises one or more distinct software modules, and wherein the distinct software modules comprise an analysis module and a control module;

receiving an m/z range of an ion beam of precursor ions using the analysis module, wherein the ion beam is received by a tandem mass spectrometer configured to select and fragment the ion beam m/z range during each cycle of a plurality of cycles, the ion beam is produced by an ionization device that receives and ionizes one or more compounds of a sample, and the one or more compounds are produced by a sample introduction device that introduces one or more compounds of a sample over time;

dividing the ion beam m/z range into two or more precursor ion mass selection windows using the analysis module, wherein each precursor ion mass selection window of the two or more precursor ion mass selection windows has an initial window m/z range corresponding to part of the ion beam m/z range;

for at least one precursor ion mass selection window of the two or more precursor ion mass selection windows, instructing the tandem mass spectrometer to perform a precursor ion survey scan mass analysis of the least one precursor ion mass selection window using the control module, producing a precursor ion mass spectrum that determines m/z values of precursor ions in the at least one precursor ion mass selection window;

determining a pattern of two or more different window m/z ranges to be used during two or more successive cycles for at least one precursor ion mass selection window of the two or more precursor ion mass selection windows that includes the initial window m/z range and one or more successively different window m/z ranges using the analysis module, wherein each of the one or more successively different window m/z ranges are chosen so that at least one precursor ion found in the precursor ion mass spectrum of the at least one precursor ion mass selection window remains in the at least one precursor ion mass selection window for all the one or more successively different window m/z ranges and the other precursor ions found in the precursor ion spectrum of the at least one precursor ion mass selection window end up in at least one other precursor ion mass selection window for at least one of the one or more successively different window m/z ranges; and instructing the tandem mass spectrometer to select and fragment the two or more precursor ion mass selection windows during each cycle of the plurality of cycles and to repeatedly use the pattern of two or more different window m/z ranges for each group of two or more successive cycles of the plurality of cycles for the selection and fragmentation of the at least one precursor ion mass selection window using the control module, producing a product ion spectrum for each precursor ion mass selection window of the two or more precursor ion mass selection windows for each cycle and producing product ion spectra for the at least one precursor ion mass selection window that include an effect of the repeated use of the pattern.

* * * * *